US006857151B2

(12) United States Patent
Jusiak et al.

(10) Patent No.: US 6,857,151 B2
(45) Date of Patent: Feb. 22, 2005

(54) BEAD CUSHIONING DEVICE

(75) Inventors: Joel T. Jusiak, Holland, NY (US); Roland E. Flick, Elma, NY (US)

(73) Assignee: Gaymar Industries, Inc., Orchard Park, NY (US)

( * ) Notice: Subject to any disclaimer, the term of this patent is extended or adjusted under 35 U.S.C. 154(b) by 0 days.

(21) Appl. No.: 10/421,995

(22) Filed: Apr. 23, 2003

(65) Prior Publication Data

US 2003/0200609 A1 Oct. 30, 2003

Related U.S. Application Data

(60) Provisional application No. 60/375,494, filed on Apr. 25, 2002.

(51) Int. Cl.[7] ..... A47C 16/00
(52) U.S. Cl. ..... 5/655.4; 5/655.9
(58) Field of Search ..... 5/655.4, 911, 655.9, 5/702, 740; 297/284.6, 452.41

(56) References Cited

U.S. PATENT DOCUMENTS

| | | | | |
|---|---|---|---|---|
| 3,552,044 A | | 1/1971 | Wiele | |
| 3,748,669 A | * | 7/1973 | Warner | 5/682 |
| 4,982,465 A | * | 1/1991 | Nagata et al. | 5/676 |
| 5,079,786 A | * | 1/1992 | Rojas | 5/655.4 |
| 5,421,874 A | | 6/1995 | Pearce | |
| 5,549,743 A | | 8/1996 | Pearce | |
| 5,592,706 A | | 1/1997 | Pearce | |
| 5,626,657 A | | 5/1997 | Pearce | |
| 5,829,081 A | | 11/1998 | Pearce | |
| 5,881,409 A | | 3/1999 | Pearce | |
| 6,020,055 A | | 2/2000 | Pearce | |
| 6,197,099 B1 | | 3/2001 | Pearce | |
| 2002/0183848 A1 | * | 12/2002 | Ray et al. | 623/17.12 |

FOREIGN PATENT DOCUMENTS

| | | | |
|---|---|---|---|
| EP | 0032486 | * | 1/1981 |
| GB | 2117235 | * | 10/1983 |

* cited by examiner

*Primary Examiner*—Jong-Suk (James) Lee
(74) *Attorney, Agent, or Firm*—Roach Brown McCarthy & Gruber, PC; Kevin D. McCarthy

(57) ABSTRACT

A cushioning device has a flexible container and a plurality of polymeric beads within the flexible container which flows under a slight force and shears easily. The cushioning device is capable of receiving a physical object that applies a force to the cushion. When the force is initially applied to the cushioning device, the cushioning device is deformed to conform to the physical object from its original shape. When the physical object is not applying the force, the cushioning device reverts to a shape that is close to but not identical to the original shape, except for a limited number of materials such as molded elastomeric materials. In addition, the pressure exerted by the cushion on the physical object will reduce pressure that would cause tissue damage and lead to decubitus ulcers.

20 Claims, 3 Drawing Sheets

BEAD CUSHIONING DEVICE

CLAIM OF PRIORITY

This application claims priority to U.S. provisional patent application Ser. No. 60/375,494, filed on Apr. 25, 2002.

FIELD OF THE INVENTION

The invention relates to beads in a cushion.

BACKGROUND OF THE INVENTION

Applicants are aware that Weile taught in U.S. Pat. No. 3,552,044 a conformable pad filled with elastomeric particles covered with a lubricant. The elastomeric particles are described by Weile at col. 2, lines 61–72; col. 3, lines 44–45 and 63–67 of the '044 patent as > pellets [can be natural rubber, urethane rubber or other synthetic elastomers) about ⅛ of an inch in diameter and random length, but normally about ⅛ of an inch long, forming small cylinders that had substantially equal dimensions in all directions, which is important for good flow properties. The softer durometer material rods are usually slightly longer ranging up to ¼ inch long. In mixing, only enough of the silicone grease to thinly coat each pellet was used. Cylinders were used in this application because of their availability, low cost and their success in testing.
>
> The interior of the pad here is shown with spherical elastomeric pellets 28. The spheres can be of uniform size or varying size and will also flow or move quickly out of the way when subjected to load, much like they cylinders previously described.

It would seem that this patent would preclude other entities from obtaining a patent on a cushion containing a bead-like spherical or cylindrical particle. That did not occur.

Presently, there are numerous recently issued patents that disclose and claim cushions containing, in essence, microspherical shaped beads. Some of these patents are U.S. Pat. Nos. 5,421,874; 5,549,743; 5,626,657; 6,197,099; 6,020,055; 5,881,409; 5,592,706; and 5,829,081, all of which are assigned to TekSource, LC and list Mr. Pearce as the sole inventor. In the specification of some of these cited references, Pearce attempted, and successfully, distinguished his microspherical beads from Weile's disclosure by stating the following:

> Robert W. Weile U.S. Pat. No. 3,552,044 issued Jan. 5, 1971 discloses a conformable pad filled with elastomeric particles covered with a lubricant (column, lines 34–38). This patent is incorporated by reference herein in its entirety. The elastomeric particles are not round or microspheres and, therefore, do not accommodate a sliding and rolling contact. Rather, the elastomeric particles are made from rods and have flat ends that would interfere with the free movement of particles in [Pearce's] composite mixture. The irregular shape of the particles provides a high resistance to flow and shear.

(Bracketed material was added for clarity and it should be noted that the column and line cite is erroneous.)

Notwithstanding Pearce's erroneous reason, there is a possible reason that Pearce's invention may have been distinguishable over the Weile reference. That reason is that Weile's cushion device is designed to have shape memory and Pearce's cushion device is designed to have de minimis shape memory. Shape memory is another way of saying the cushion will revert to its original shape after the forces are applied thereto.

To explain the problems associated with shape memory, we revert to the disclosure set forth in Pearce's U.S. Pat. No. 5,829,081. In that reference Pearce discloses "It is well known that persons who must sit or lie in a reclined position for extended periods of time experience localized tissue breakdown leading to decubitus ulcers (pressure sores), which in turn can lead to extensive hospital stays, and in severe cases, even amputation. The tissue breakdown of decubitus ulcers is caused by lack of blood circulation in localized areas. Blood circulation is slowed or prevented when pressure in the tissue caused by an external source exceeds the internal blood pressure in the capillaries and vessels of the tissue. Such excessive localized external pressure often occurs when a person sits or lies on traditional cushioning devices, which can cause higher pressures on bony prominence (e.g. hip bones) than on non-prominent areas.

Traditional cushioning devices consist of flexible foams which when deformed behave similar to springs. The more the deformation, the more force the foam applies to the deforming object in an effort to return to its original undeformed shape (i.e., the foam has "memory"). When the deforming object on a cushion is a portion of human body, the deforming force causes excessive pressure on body tissue which can lead to discomfort or to decubitus ulcers.

Supporting pressure on the tissues of sitting or lying persons cannot be eliminated, since in order for the person to be supported, the total cushioning force on all of his/her tissues must equal the weight of the person. The objective of an effective cushion is not to eliminate these supporting forces, but to distribute them as evenly as possible to eliminate peak pressures, and to distribute them over as large an area as possible to minimize average supporting pressure. In most cases, and specifically in the cases of wheelchair cushions and bed mattresses, the area of human tissue to which supporting force is applied is large enough that if the cushioning force is equalized over that entire area, the pressure on the human tissue will be less than that which causes decubitus ulcers. The pressure at which circulation is slowed to the point that tissue damage and decubitus ulcers become a substantial danger is 30 millimeters of mercury.

Optimally, a cushion should have a shape that is precisely the complementary shape of the object being cushioned so that it contacts and supports each protrusion and crevice of the cushioned object. This results in the supporting forces being applied to the cushioned object over the largest possible area, resulting in the lowest possible supporting pressure. To achieve this goal, the cushion material must not be attempting to return to some other shape (i.e., it must not have memory)."

In other words, Pearce is disclosing that cushions that have no shape memory are desired. He explains this position by stating: "A flat foam cushion is very ineffective at achieving these goals because: (1) the cushion is not originally shaped to match the contours of the object to be rested on it, and when an object is placed on the foam cushion, the foam imperfectly re-shapes to the object's contour, not utilizing the entire surface area over which the supporting force is applied; and (2) because of its memory, the foam attempts to rebound and return to its original flat shape, applying stressful pressure to the cushioned object in direct proportion to the degree to which the foam cushion has been deformed. The prominent areas of a human body being cushioned (e.g., the area near hip bones) deform the foam from its original flat shape more so than do other areas of the body, causing the pressure to be very high near the prominent areas in comparison with the non-prominent areas.

These pressure peaks can cause discomfort and can cause tissue damage that leads to decubitus ulcers.

Pre-shaping the foam (e.g., cutting it to match a particular body contour) is only marginally effective at achieving equalized pressure distribution[. This is so] because the cutting process is inherently inaccurate, precise placement of the object or person on the contoured foam cushion is difficult, movement of the object or person on the cushion defeats the benefits of the contour, and the memory of even pre-shaped finite-thickness foam causes undue pressure on body tissue and can lead to tissue damage.

In addition to foam cushions, the prior art includes various fluid-filled cushions. Most prior art fluid-filled cushions have been more effective than foam cushions in equalizing supporting pressures. The prior art fluid-filled cushions consist of large single bladders (compartmentalized or single-compartment) filled with a fluid (some type of liquid or gas/air). Some of the prior art bladders are placed atop a shaped tray, the edges of which prevent the fluid from flowing laterally. Fluids are more effective than foam in providing non-damaging cushioning to human tissue because they have relatively little shape memory, and if properly containerized, they will flow to generally match the contour of the body being cushioned.

All fluid cushions . . . depend on "hammocking" to suspend the person on the cushion fluid within the cushion bladder(s). Hammocking is defined as the tensioning of the top surface of a bladder material by limiting its edge (i.e., side) movements when a force is applied to the top surface of the bladder in the general direction of the fluid beneath. This is similar to the mechanics of a well-known sleeping hammock which has its ends restricted from moving by being tied between two trees, thereby tensioning the hammock to support a person lying on the hammock. If cushions provided no hammocking, the person sitting or lying on the cushion would sink through the fluid in the bladder(s) and bottom out on the surface beneath the fluid-filled bladder(s). This can be proven by the principle of physics that the buoyant (upward) force on an object in a fluid is equal to the weight of the fluid displaced by the object. In order to suspend a person on a fluid cushion without hammocking, the person would have to sink deep enough into the fluid to displace his/her body weight of fluid. This cannot occur in any prior art fluid cushions or the invented cushion, all of which are limited to a few inches in thickness. Thus, the suspension of the person is not entirely from buoyancy in fluid, and is in fact mostly from hammocking of bladder material.

The objective of a fluid-filled cushion, therefore, should not be to eliminate hammocking, but to distribute the hammocking forces over as large an area of the supported object as possible and as evenly as possible. Prior art fluid cushions fail to do this. Single bladder non-segmented cushions of the prior art must stretch the bladder skin tightly (i.e., fill the cushion very full with fluid) to prevent bottoming out. Otherwise the fluid under protruding body parts would flow not just to non-protruding parts (which would in fact help equalize pressure), but also to parts of the bladder on which the person is not sitting, thus allowing the person to sink through the fluid to the surface beneath the cushion. This prior art practice of filling the cushion very full creates a single hammock from edge to edge of the cushion. A single hammock has high peak pressures because it suspends protruding body parts on the bladder material first, placing additional pressure on those protruding parts when the full weight of the person deforms the resistive bladder further, and it does not fully conform to the contours and crevices of the cushioned body. Thus, a single bladder cushion has some characteristics and negative attributes similar to foam.

In an attempt to solve these problems, recent prior art cushioning devices have used a segmented bladder to prevent fluid flow from one segment or cell to another. For example, some prior art bladders are quadrilaterally segmented by sealing the top surface of the bladder to its bottom surface to create four segmented cells in such a way as to prevent fluid from flowing from the forward half to the back half, or from the left half to the right half, or etc. This creates four hammocks, and so distributes load better than a single hammock.

Unfortunately, the prior art methods of segmenting a single large bladder (i.e., selectively sealing the top bladder surface to the bottom bladder surface) created a situation in which the bladder surfaces, and hence also the fluid, were movement-restricted by these segmenting seals and could not fully conform to the irregular surface of the user's body. This reduced the total surface area of human tissue onto which the cushioning force was applied, thus raising the average pressure and increasing the danger of tissue damage. Also, the small number of bladder segments used by the prior art created some peak pressure areas. Additionally, because this cushion design prevented fluid from flowing from one segment or cell of the cushion to another, pressure equalization among cells was not achieved and the danger of decubitus ulcers from high pressure spots was not eliminated."

To address this alleged problem, Pearce disclosed "a cushion that has a plurality of separate bladders each containing a quantity of fluid. The bladders each have a hammocking function to distribute pressure evenly across a supported load." In an alternative embodiment, the bladder is "partly filled with a fluid accommodates flow and shaping of the bladders and the cushion to conform to any irregular shape." In a further embodiment, Pearce discloses, "It is an object of the invention to provide a cushion that has little or no shape memory. By using a low-memory flowable fluid filler [like a microspherical object) in the bladders of the invented cushion in conjunction with a loose-skinned flexible bladder material, a cushion without the problems of memory materials such as traditional foam is achieved.

Applicants have, however, determined that full shape memory or little to no shape memory cushions is undesired. Full shape memory is undesired for the reasons set forth by Pearce. And little to no shape memory is undesired by customers because the cushion after numerous uses eventually bottoms out. Once the cushion bottoms out, the cushion provides as much bed sore benefit, or even less thereof, as a full shape memory cushion. Accordingly, Applicant has solved at least this problem.

SUMMARY OF THE INVENTION

The present invention is directed to a cushioning device. The cushioning device has a flexible container and a plurality of polymeric beads within the flexible container which flows under a slight force and shears easily. The cushioning device is capable of receiving a physical object that applies a force to the cushion. When the force is initially applied to the cushioning device, the cushioning device is deformed to conform to the physical object from its original shape. When the physical object is not applying the force, the cushioning device reverts to a shape that is close to but not identical to the original shape, except for a limited number of materials such as molded elastomeric materials. In addition, the pressure exerted by the cushion on the physical object will reduce pressure that would cause tissue damage and lead to decubitus ulcers.

DETAILED DESCRIPTION OF THE PREFERRED EMBODIMENTS

Figure 1:
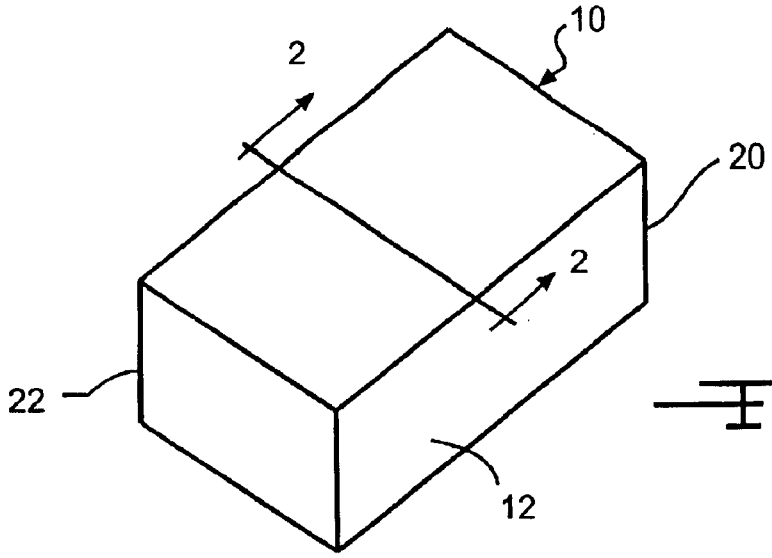
FIG. 1 depicts a top view of a uniformly shaped cushion of the invention.
Figure 2:
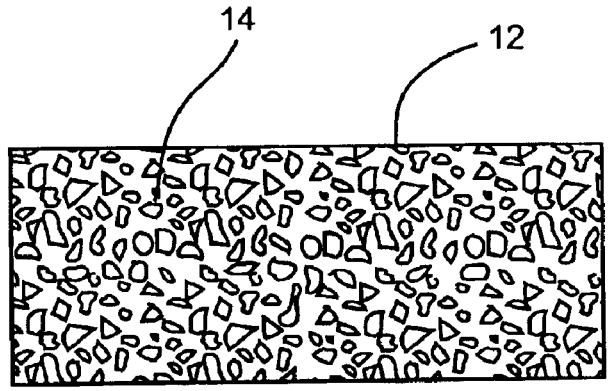
FIG. 2 depicts a cross-sectional view of FIG. 1 taken along the lines 2—2.

The present invention is directed to a cushioning device 10, as illustrated in FIG. 1. The cushioning device has a flexible container 12 and a plurality of polymeric beads 14, as illustrated in FIG. 2, within the flexible container 12. The beads 14 are designed to flow under a slight force and easily shear.

Figure 3:
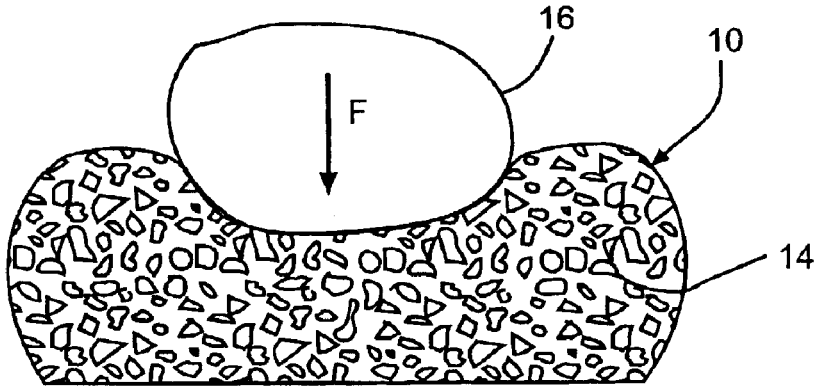
FIG. 3 depicts a cross-sectional view of FIG. 1 with a force applied thereto.

The cushioning device is capable of receiving a physical object 16, as shown in FIG. 3, that applies a force (F) to the cushion 10. When the force (F) is applied to the cushioning device 10, the cushioning device 10 deforms from its original shape, an example thereof is illustrated in FIG. 2, to conform about a portion of the physical object 16, as illustrated in FIG. 3.

Figure 4:
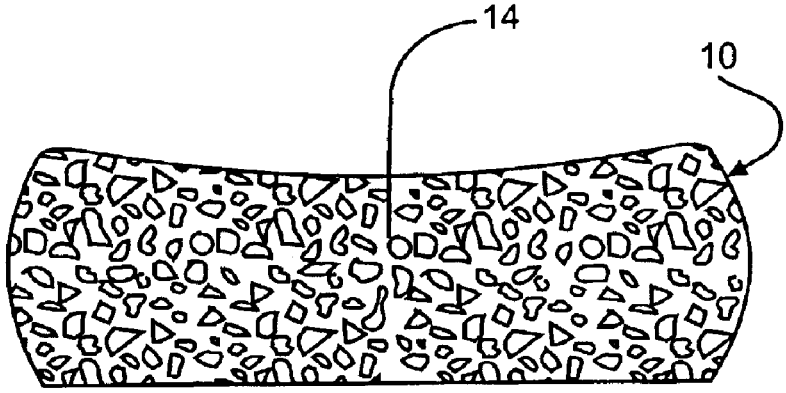
FIG. 4 depicts a cross-sectional view of FIG. 3 without a force applied thereto.

When the physical object 16 is removed from the cushioning device 10, the cushioning device 10 reverts to a shape, see FIG. 4, that is close to but not identical to the original shape, except for a limited number of materials such as molded elastomeric materials, see FIG. 2. This means the present invention does not have shape memory cushions nor shape memory cushions; instead the present invention has quasi-shape memory since it attempts to revert to its original shape but is unable to do so without outside assistance.

By providing quasi-shape memory, the present cushioning device exerts pressure on the physical object that will reduce pressure that would cause tissue damage and lead to decubitus ulcers. Simultaneously, by providing a quasi-shape memory cushioning device, the present invention is, for the most part, incapable of bottoming out. Bottoming out occurs when the cushioning device 10 essentially has no interior material, like beads, foam, or a fluid, beneath the physical object. Bottoming out increases the chances of decubitus ulcers. Thus, a quasi-shape memory cushion decreases the chances of bottoming out which is the result of no shape memory cushioning devices (Pearce's patents).

Turning to the present invention, the preferred flexible container is sometimes called a bladder. The bladder material can be any conventional fluid impermeable material used in mattress systems and/or pads. In any case, the bladder material is made of any material that is pliable, durable enough to resist tearing or puncturing during use, and fluid-impermeable. It is also desirable, but not necessary, for the bladder material to have some elasticity to accommodate deformation of the bladders under stress. In many applications, a thin film is a desirable bladder material not only for the flexibility provided, but for light weight. In a preferred embodiment, the bladder has a thickness ranging between 0.010 to 0.020 inches thick and is preferably a polyurethane film. Any other pliable, tough plastic or rubber film is acceptable, such as latex rubber or synthetic elastomer.

Figure 5:
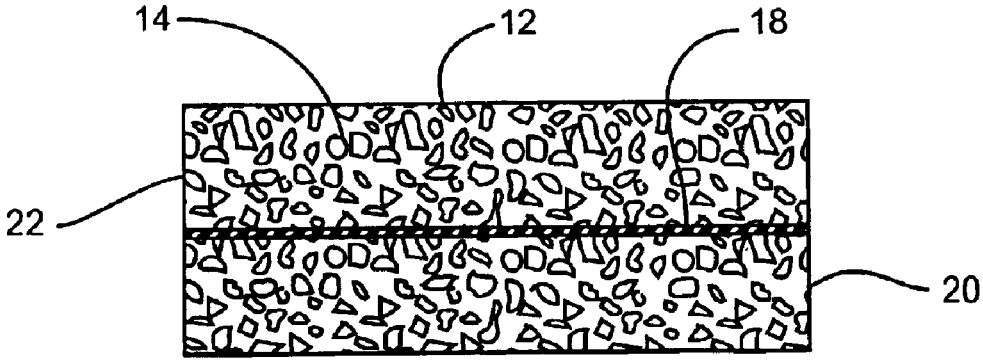
FIGS. 5 to 7 illustrate alternative embodiments of FIG. 1.

To further assist the cushion device 10 maintain its quasi-shape memory features, the applicants have found that the addition of a resilient member to the bladder is sometimes beneficial. The resilient member 18, as illustrated in FIG. 5, is attached to two interior and opposite sides 20, 22 of the bladder 12. The resilient member 18 attaches to the sides 20, 22 by conventional methods, such as button hooks and/or being stitched thereon.

Figure 6:
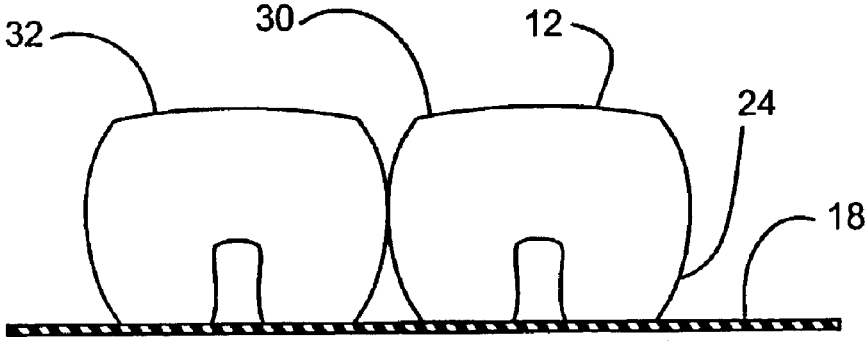

Alternatively, the resilient member 18 can be attached to the exterior surface 24 of the bladder 12, as illustrated in FIG. 6. The resilient member 18 can be attached to the bladder 12 in any conventional manner. In a preferred embodiment of this alternative embodiment, the bladder 12 attaches to the resilient member 18 in two distinct positions. The double attachment method allows a first cushion device 30 be positioned adjacent to a second cushion device 32. Thereby, the first and second cushion devices 30, 32 assist in the present invention maintaining its quasi-shape memory function.

When the first and second cushion devices 30, 32, whether attached to a resilient member 30 or not, are adjacent to each other, the first and second cushion devices 30, 32 assist in the present invention maintaining its quasi-shape memory function. This is a feature utilized in bladder-type mattress systems, and other bladder-type cushion devices. The present cushioning devices having a single or numerous bladder 12, can be used in or on various mattress systems and/or cushion units, like chair cushions. In particular, the cushioning device 10 can be an overlay, and/or incorporated into the desired cushion unit and/or mattress. The cushion device, including a mattress, can have a crib, or no crib, that surrounds the cushioning device.

Even if a resilient member is not used, the cushioning device can attach to a base, which can be the resilient member, by many conventional methods. Some of these conventional methods include and are not limited to stitching, hook and loop fastener system, adhesives, and combinations thereof.

In addition, a desired shape of the bladder 12 is a trapezoid, wherein the long side supports the physical object. In some embodiments, the short side is attached to the resilient member 18. That way, the long side provides the most surface area to the physical object.

Figure 7:
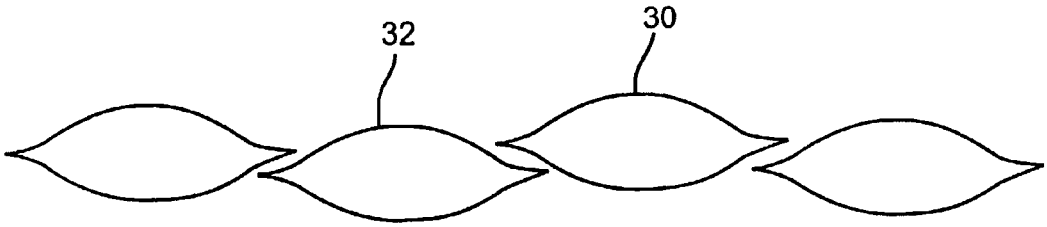

Alternatively, the first bladder 30 can nest over at least a portion of the second bladder 32, as illustrated in FIG. 7. That way, there is decreased chance of bottoming out occurring between the bladders 30, 32.

Another embodiment of the present invention is that bladder 12 has an interior cavity and the interior cavity can be divided into at least two sections. The two sections can be divided by an interior fluid impermeable flexible barrier, or a fluid permeable flexible barrier that allows a fluid to flow between the two sections. The barrier material can be any conventional material that accomplishes the desired function. In particular, the barrier can be of the same material as the bladder 12, with or without apertures.

Within the bladder 12 can be numerous items. One of the items that must be in the bladder is a plurality of polymeric beads. As previously stated, these beads must be able to flow under a slight force and easily shear when the force is applied thereto. The beads can be any shape. For example, the beads can be shaped like a hockey puck, a football, a basketball, a baseball, a rugby ball, a tennis ball (with a fuzz like substance thereon), a bucky ball or variations thereof, or combinations thereof.

The beads can be made of any polymeric material but a preferred base material for the beads is polyethylene, polystyrene or combinations thereof. That base material can be further incorporated with conventional non-sticking, slippery materials, that are used in films or other polymeric materials that desire the polymeric material to be slippery and able easily slide.

In one embodiment, the beads can be chemically or thermally modified. By modifying the beads, the beads can better retain the lubricating fluid and also minimize the surface contact between two adjacent beads. That means the beads can slide better and more efficiently.

The beads can also be lightly lubricated. The lubrication material is an inert viscous material in relation to the beads that provides a desired viscosity, preferably ranging from about 300 to about 300,000 centistokes. Admittedly, this lubricant increases the slidability of the beads, but that can be controlled by adding the desired amount of slip materials into the beads. Conventional lubricants include and are not limited to silicone based material, like polydimethylsiloxane, and natural oils, like olive oil. In at least one embodiment the lubricant is incorporated into the beads, and in another the lubricant is on the beads.

Along with the lubricant, the bladder 12 can contain fibrous material that controls the movement of the polymeric beads.

The bladder 12 can also contain a fluid. The fluid can be any gas or liquid that is inert to the bladder 12, the beads, and any other material contained in the bladder 12. Preferably the gas is air and the fluid, if used, is water. In any case, the fluid can be in a self-contained system. The self-contained system can be just in the bladder 12, or in the bladder 12 and, for example, a reservoir that receives the exhausted fluid from the bladder 12. Alternatively, the fluid can be in an open system. By an open system, the fluid is exhausted through at least one aperture in the bladder 12 when a force is applied thereon, and when the force is not applied to the bladder 12 the fluid returns to the bladder 12. In most cases, the fluid in the open system is ambient air.

In other cases, the fluid can be a predetermined temperature. If a predetermined temperature is desired, the fluid can obtain the desired temperature prior to entering the bladder 12 by using Gaymar's Medi-Therm® fluid temperature control device.

Any cover can be used to surround the cushion assembly 10 provided that the top skin of the cover is loose enough or elastomeric enough to allow freedom of movement of the bladder skins. If a non-elastomeric cover is used, there should be little enough friction between cover and bladder to permit the bladder movement and deformation needed to accommodate body shape. Alternatively, the invention may be used without a cover.

The bladders of the present invention can be positioned one on top of each other or positioned adjacent to each other and separated at least by a portion by a weld. If the latter design is used, it may be desired to nest a second set of bladders on the first set of bladders so the second set of bladders covers the weld portion of the first set of bladders.

The invention may be made in many sizes as appropriate for the user and for the intended use. The top surface area of individual bladders 12 can be of any size that accommodates deformation into the irregularities of the object being cushioned. If the top surface area of the bladder is too large, the bladder will span across the object's protrusions and exhibit peak pressures. If the top surface area of the individual bladder is too small, then the bladder will not be able to completely deform into the object's recessions and full distribution of support will not be achieved. The optimum number of bladders can be roughly calculated by dividing the top surface area of an optimally sized individual bladder into the top surface area of the overall cushion. The height of the bladders (i.e., the thickness of the cushion) must be sufficient to prevent bottoming out of the object's tallest protrusion.

The preferred embodiments of the present invention directed to cushioning device is for example, mattress, patient adjustment devices, foot cushion, and wheelchair cushions, which are described above and which are not intended to be limiting of the scope of the invention. The invention as defined by the term cushioning device includes and is not limited to other products such as wheelchair backs, stadium seat cushions, bicycle seat cushions, automobile seat cushions, saddles, secretarial chairs, lounge chairs, lumbar supports, life jackets, footwear and others. The invention is also useful for cushioning of items other than the human body, such as fragile manufactured goods during shipping.

While the present invention has been described and illustrated in conjunction with a number of specific embodiments, those skilled in the art will appreciate that variations and modifications may be made without departing from the principles of the invention as herein illustrated, described and claimed. The present invention may be embodied in other specific forms without departing from its spirit or essential characteristics. The described embodiments are to be considered in all respects as only illustrative, and not restrictive. The scope of the invention is, therefore, indicated by the appended claims, rather than by the foregoing description. All changes which come within the meaning and range of equivalency of the claims are to be embraced within their scope.

We claim:

1. A cushioning device comprising:

a flexible container, a plurality of polymeric beads within the flexible container which flows under a slight force and shears easily, the cushioning device capable of receiving a physical object that applies a force to the cushioning device, when the force is initially applied to the cushioning device, the cushioning device is deformed to conform to the physical object from its original shape and when the physical object is not applying the force, the cushioning device reverts to a shape that is close to but not identical to the original shape;

wherein pressure exerted by the cushioning device on the physical object will reduce pressure that would cause tissue damage and lead to decubitus ulcers.

2. The cushioning device of claim 1 wherein the polymeric beads have a lubricant thereon.

3. The cushioning device of claim 2 wherein the lubricant is an inert viscous material.

4. The cushioning device of claim 3 wherein the inert viscous material is a silicone-based material or a natural oil.

5. The cushioning device of claim 4 wherein the silicone based material is polydimethylsiloxane.

6. The cushioning device of claim 4 wherein the natural oil is olive oil.

7. The cushioning device of claim 1 wherein the polymeric beads have a slip material.

8. The cushioning device of claim 1 wherein the polymeric beads have a predetermined viscosity.

9. The cushioning device of claim 1 wherein the flexible container has a resilient member attached to at least two points in the interior or exterior of the flexible container.

10. The cushioning device of claim 1 wherein the flexible container is attached to a resilient member.

11. The cushioning device of claim 1 wherein the flexible container overlies a portion of a second cushioning device.

12. The cushioning device of claim 1 wherein the flexible container is adjacent to a second cushioning device.

13. The cushioning device of claim 1 wherein the cushioning device has at least one interior surface within the flexible container to form at least two compartments within the flexible container.

14. The cushioning device of claim 1 wherein the cushioning device further comprises foam.

15. The cushioning device of claim 1 wherein the cushioning device further comprises a fluid.

16. The cushioning device of claim 1 wherein the cushioning device further comprises fiber fill to control the suspension of the polymeric beads.

17. The cushioning device of claim 1 wherein the polymeric bead is selected from the group consisting of polyethylene, polystyrene, and combinations thereof.

18. The cushioning device of claim 1 wherein the polymeric bead can have any shape.

19. The cushioning device of claim 1 wherein the flexible container is trapezoidal in shape.

20. The cushioning device of claim 1 wherein the cushioning device is a bladder used in or on a mattress system.

* * * * *